US006352450B1

(12) United States Patent
Bronk et al.

(10) Patent No.: US 6,352,450 B1
(45) Date of Patent: Mar. 5, 2002

(54) ELECTRICAL CONNECTOR HAVING A SINGLE RECEPTACLE CAPABLE OF RECEIVING A PLURALITY OF PLUGS

(75) Inventors: Arthur H. Bronk, San Jose; Keith R. Carver, Alameda, both of CA (US)

(73) Assignee: Cableco Technologies Corporation, San Jose, CA (US)

( * ) Notice: Subject to any disclaimer, the term of this patent is extended or adjusted under 35 U.S.C. 154(b) by 0 days.

(21) Appl. No.: 09/522,902

(22) Filed: Mar. 10, 2000

(51) Int. Cl.[7] ..... H01R 25/00
(52) U.S. Cl. ..... 439/660; 439/111; 439/877
(58) Field of Search ..... 439/660, 676, 439/116, 121, 111, 887, 888, 877

(56) References Cited

U.S. PATENT DOCUMENTS

| | | | | | |
|---|---|---|---|---|---|
| 2,240,180 | A | * | 4/1941 | Frank | 439/111 |
| 2,247,041 | A | * | 6/1941 | Bergan | 439/877 |
| 2,701,186 | A | | 2/1955 | Obenschain et al. | |
| 3,392,363 | A | | 7/1968 | Geis, Jr. et al. | |
| 3,801,951 | A | * | 4/1974 | Kemmerer et al. | 439/116 |
| 4,211,461 | A | | 7/1980 | Wescott | |
| 4,289,365 | A | * | 9/1981 | Rutgers | 439/116 |
| 4,394,533 | A | * | 7/1983 | Naito | 439/877 X |
| 5,332,397 | A | * | 7/1994 | Ingalsbe | 439/76 |
| 5,380,223 | A | | 1/1995 | Marsh et al. | 439/610 |
| 5,486,117 | A | | 1/1996 | Chang | 439/357 |
| 5,695,355 | A | | 12/1997 | Hasenfratz et al. | 439/357 |
| 5,727,963 | A | | 3/1998 | LeMaster | 439/358 |
| 5,813,877 | A | | 9/1998 | Nakamura | 439/267 |
| RE36,900 | E | * | 10/2000 | Taylor | 439/887 X |

* cited by examiner

*Primary Examiner*—Renee Luebke
(74) *Attorney, Agent, or Firm*—Roylance, Abrams, Berdo & Goodman, L.L.P.

(57) ABSTRACT

An electrical connector for connecting an electrical cable to a conductive member having an electrically conductive female member and a substantially continuous electrically conductive male member. The female member has an open-ended longitudinal slot with a width A and a plurality of electrically conductive tines mounted in the slot. The male member is formed from an open-ended hollow tube with the electrical cable inserted into the open end. The tube and the cable are simultaneously compressed, thereby coupling the cable within the tube and forming a planar tab with substantially parallel first and second sides defining a height B and a width C. The planar tab is received within the longitudinal slot of the female member, the parallel sides of the planar tab contacting the electrically conductive tines. The width A of the longitudinal slot can be similar in size to the planar tab for receiving one planar tab or the slot can be at least twice as large as width C of the planar tabs, thereby allowing the longitudinal slot to receive a plurality of the planar tabs.

24 Claims, 7 Drawing Sheets

ELECTRICAL CONNECTOR HAVING A SINGLE RECEPTACLE CAPABLE OF RECEIVING A PLURALITY OF PLUGS

FIELD OF THE INVENTION

The invention relates to a connector for electrically conductive cable. More particularly the invention relates to a connector for electrically conductive cable having an electrically conductive female member and a continuous electrically conductive male member. The female member has a longitudinal slot with a width A and electrically conductive tines mounted in the slot. The male member is formed from an open-ended hollow tube with the conductive cable inserted into the open end. The tube and the cable are simultaneously compressed, thereby coupling the cable within the tube and forming a planar tab with substantially parallel sides defining a height B and a width C. The planar tab is received within the longitudinal slot of the female member, the parallel sides of the planar tab contacting the electrically conductive tines. The width A of the longitudinal slot can be similar in size to the planar tab for receiving one planar tab, or the slot can be at least twice as large as width C of the planar tabs, thereby allowing the longitudinal slot to receive a plurality of the planar tabs.

BACKGROUND OF THE INVENTION

In most electrical devices, an electrical connection is necessary either to transfer power to or from the device. The electrical connection in many instances is a wire coupled to an end tab having a hole through the center. The tab is then placed around a bolt by having the bolt inserted into the hole in the end tab and threading a nut onto the bolt. This procedure secures the end tab and thus the wire to an electrical device, allowing current to flow either from the wire to the device or vice versa. However, the connection requires tools to assemble and disassemble, possibly making quick changes, improvements or expansion in the electrical system impracticable, if not impossible.

Other electrical connectors have used quick release locking clamps to secure a male portion to a female portion. The existing connectors generally use multiple pins inserted in multiple holes on the female portion. In many connections, this type of connector is adequate; however, in a low voltage power connection, this type of connector results in a high voltage drop, making the connection inefficient. In low voltage connections, it is necessary to form a connector with a relatively large contact surface area between the two portions of the connector, resulting in low contact resistance and therefore a low voltage drop.

Another shortcoming of this type of connector is its inability to let the electrical system expand. Conventional connectors are designed with a female portion capable of receiving one male portion. This makes expanding the electrical system difficult by requiring that entirely new connections be built and installed in the system.

Examples of these prior art connectors are disclosed in the following U.S. Pat. Nos.: 5,95,3553 to Hasenfratz et al; 5,813,877 to Nakamura; 5,727,963 to Lemaster; 5,486,117 to Chang; 5,380,223 to Marsh et al; 4,211,461 to Wescott; 3,392,363 to Geis, Jr. et al; and 2,701,867 to Obenschain et al.

Thus, there is a continuing need to provide improved electrical connectors.

SUMMARY OF THE INVENTION

Accordingly, it is an objective of the present invention to provide an electrical connector having a female member capable of receiving a plurality of male members.

Another object of the present invention is to provide an electrical connector having a continuous male member with a relatively large contact surface area and a female member with a relatively large contact surface area, resulting in a connection with a low contact resistance and therefore a low voltage drop.

A further object of the present invention is to provide an electrical connector having a quick release mechanism that does not require tools to assemble or disassemble, making quick changes, improvements, and expansion to the electrical system simple.

The foregoing objects are basically obtained by providing an electrical connector for connecting an electrical cable to a conductive member, the combination comprising an electrically conductive female having an open-ended longitudinal slot with a width A and at least one electrically conductive tine received therein, a substantially continuous, electrically conductive male member having a planar tab, said tab having substantially parallel first and second sides defining a height B and a width C, and receivable within the longitudinal slot, at least one of the first and second parallel sides contacting at least one tine, wherein the width A of the longitudinal slot is at least twice as large as width C of the planar tab, thereby allowing the longitudinal slot to receive a plurality of the planar tabs.

Other objects, advantages and salient features of the invention will become apparent from the following detailed description, which, taken in conjunction with the annexed drawings, disclose preferred embodiments of the invention.

BRIEF DESCRIPTION OF THE DRAWINGS

Referring to the drawings which form a part of this disclosure.

DETAILED DESCRIPTION OF THE INVENTION

Figure 1:
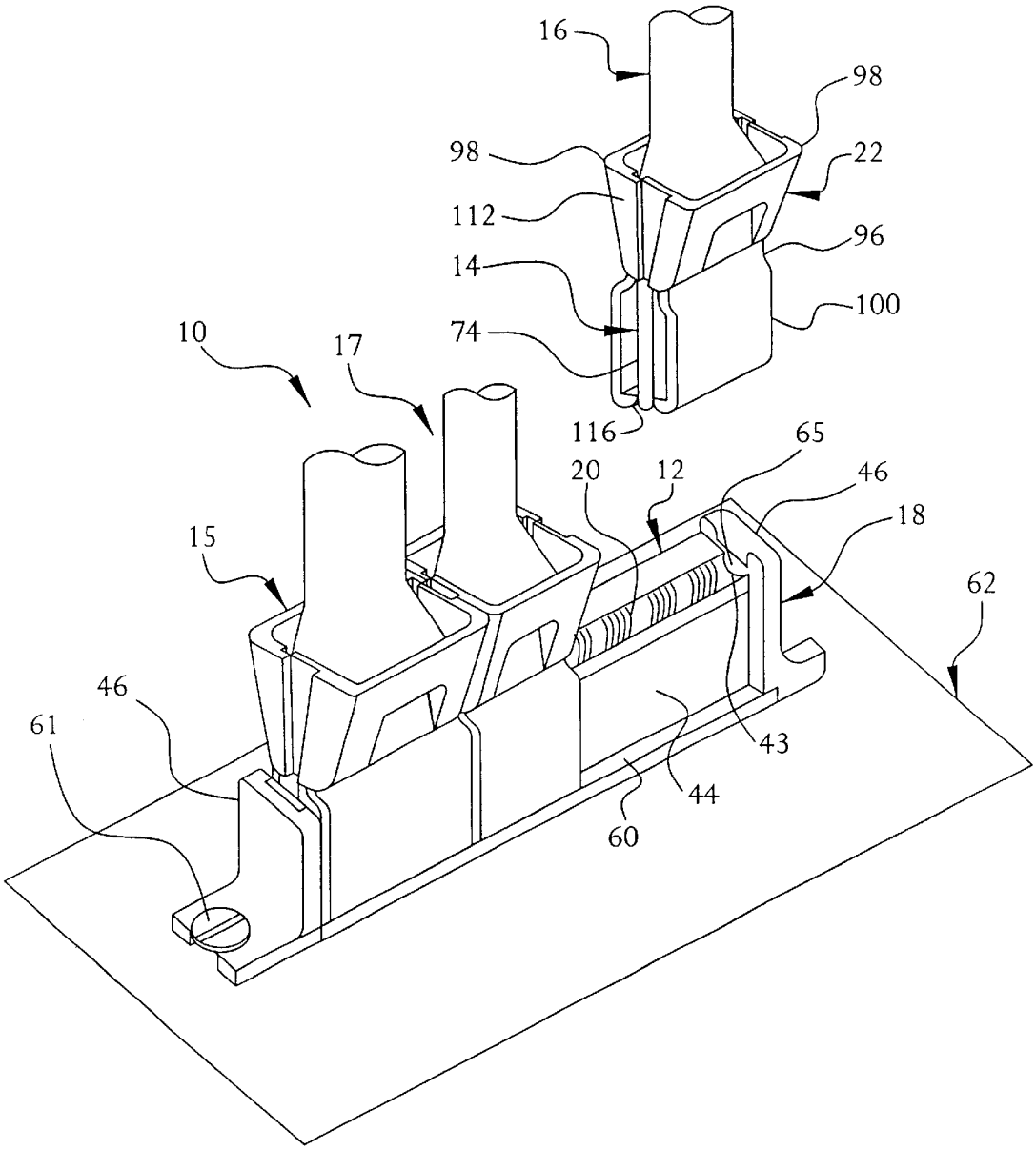
FIG. 1 is a perspective top view of an electrical connector in accordance with the present invention, illustrating the female member receiving multiple male members.

As seen in FIGS. 1–7, the electrical connector 10 in accordance with the invention comprises an electrically conductive female member 12, an electrically conductive male member 14 slidably received in the female member, and an electrically conductive cable 16 coupled to the male member. Female member 12 has a housing 18 and a plurality of electrically conductive internal contacts 20. Male member 14 has a housing 22 that releasably engages housing 18 on female member 12 ensuring that the female and the male members do not inadvertently separate. Female member 12 may be designed to receive multiple electrically conductive male members 14, 15 and 17, as seen specifically in FIG. 1.

Figure 7:
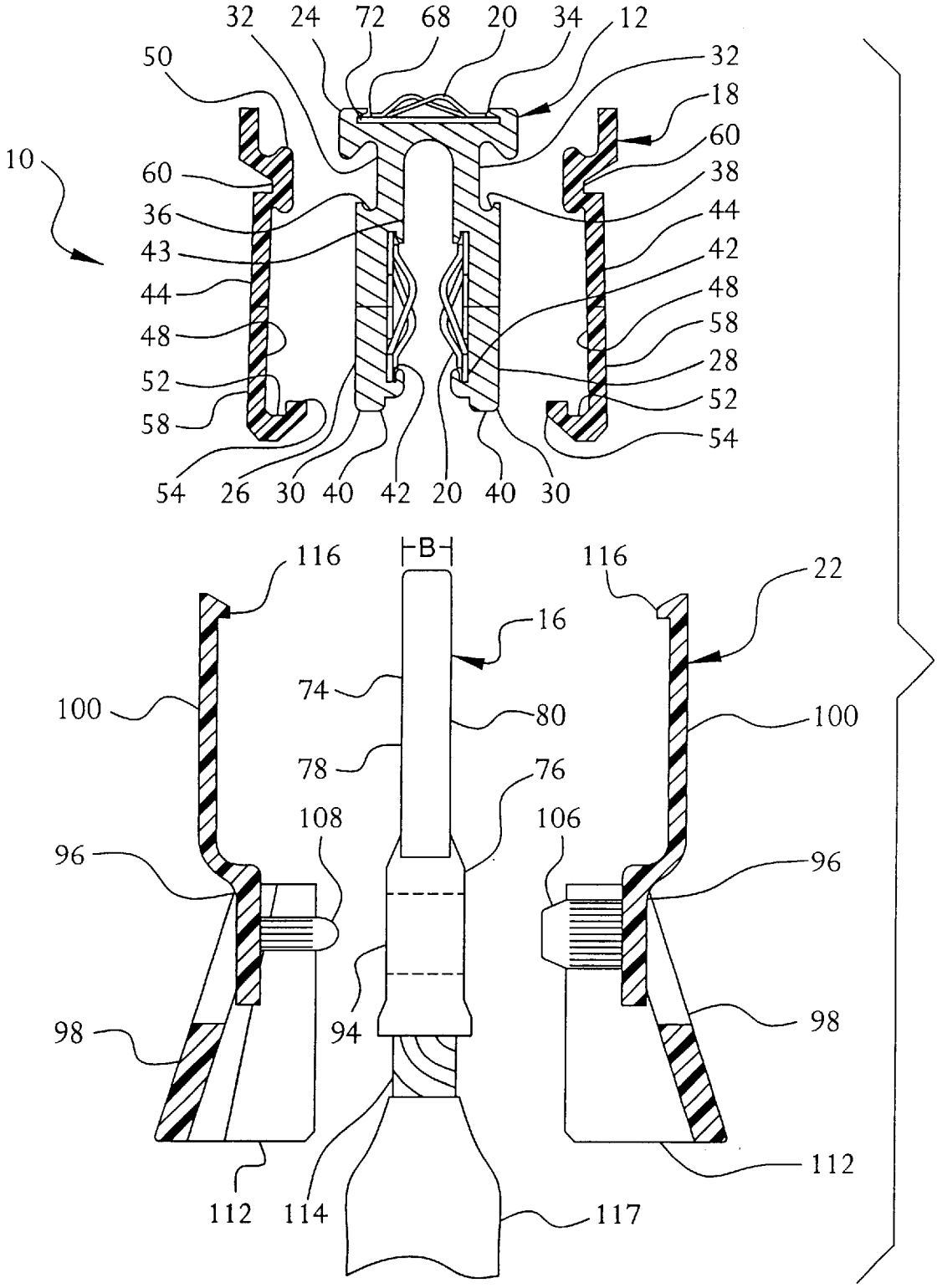
FIG. 7 is an exploded cross-sectional side view of the electrical connector illustrated in FIGS. 2, 5 and 6.
Figure 8:
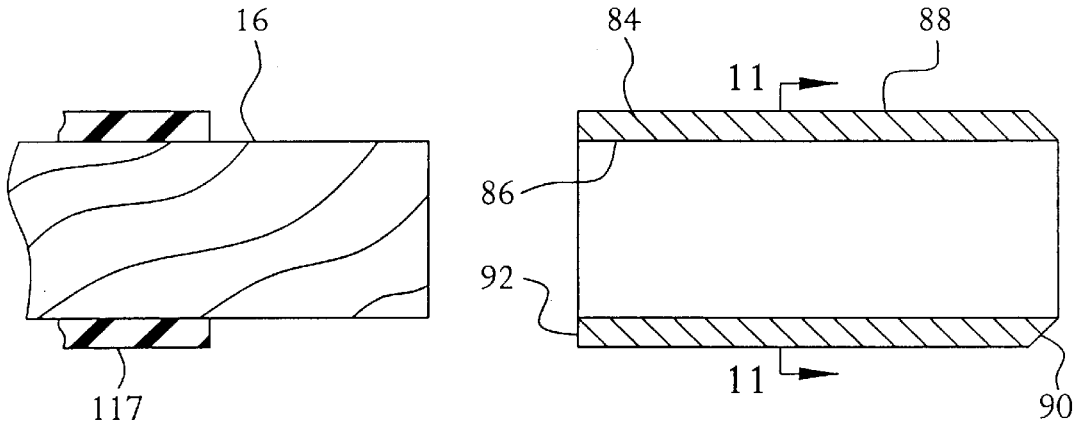
FIG. 8 is a cross-sectional side view of the male member of the electrical connector illustrated in FIGS. 2 and 5–7 prior to the insertion of the electrical cable into the male member and prior to compressing the tube and cable to form a continuous male member.

Female member 12 is preferably formed of silver plated extruded aluminum and has a base 24 with two longitudinal arms 26 and 28 extending therefrom at a substantially perpendicular angle to the base and substantially parallel to each other. Each longitudinal arm has a distal end 30 and a proximal end 32. As seen in FIG. 7, base 24 has an exterior open ended longitudinal groove 34 extending substantially the same width as the female member for slidably receiving contacts 20. However, it is possible to insert insulation into groove 34 to insulate the base of female member 12, resulting in a cable to cable connection when multiple male members are used. Arms 26 and 28 have exterior open ended longitudinal grooves 36 and 38, respectively, extending substantially the same width as the arms and adjacent proximal end 32 for receiving housing 18. Arms 26 and 28 also have protrusions 40 extending substantially the same width as the arms and adjacent distal end 30 for coupling with housing 18.

Figure 2:
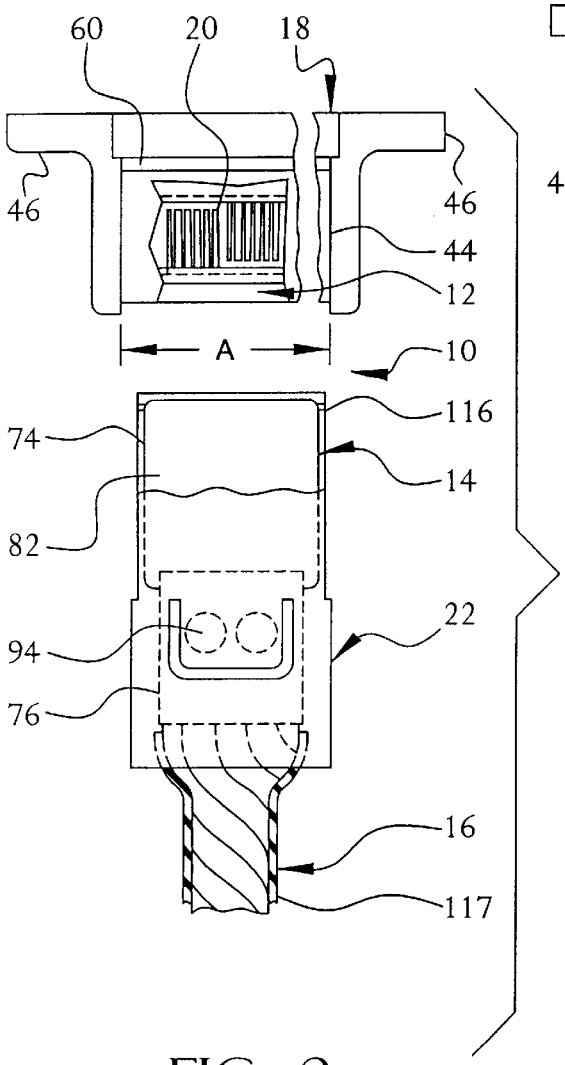
FIG. 2 is an exploded partial cross-sectional side view of an electrical connector in accordance with the present invention.
Figure 3:
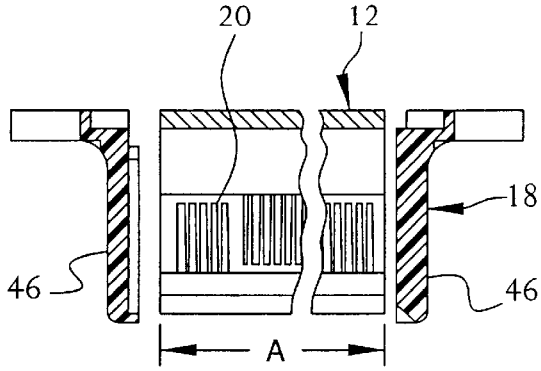
FIG. 3 is an exploded cross-sectional side view of the female member of the electrical connector illustrated in FIG. 2.

The interior of arms 26 and 28 have open-ended longitudinal grooves 42 extending substantially the same width as the arms for receiving a plurality of contacts 20. However, it is possible to design the interior of the arms so that only one arm receives contacts or neither arm receives contacts, the electricity passing directly through the electrically conductive female member. The interior of the arms and the base define a substantially U-shaped open ended longitudinal slot 43 having a width A, as seen in FIGS. 2 and 3.

Width A may be 0.5 inches or greater, dependent on the width of the male member and the number of male members to be inserted. Female member 12 may be designed to engage one male member 14 or multiple male members. For example, FIG. 1, shows female member 12 receiving three male members 14, 15, and 17. FIG. 1 is not meant to limit female member 12 to reception of three male members, female member 12 may be designed to receive any number of male members.

Figure 5:
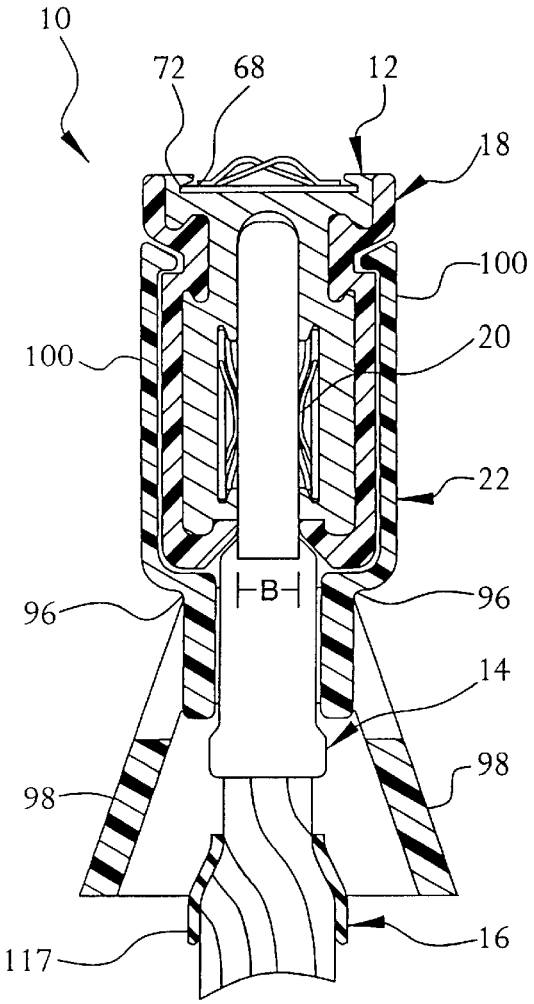
FIG. 5 is a cross-sectional side view of the male and female members of the electrical connector illustrated in FIG. 2 coupled together.
Figure 6:
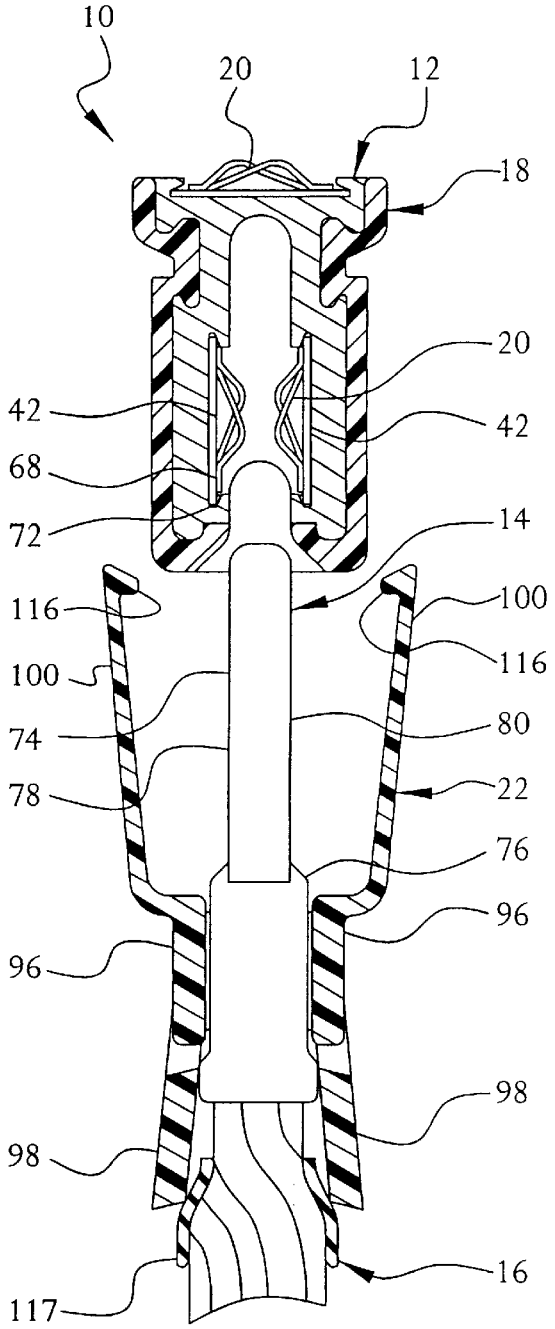
FIG. 6 is a cross-sectional side view of the male and female members of the electrical connector illustrated in FIGS. 2 and 5 just prior to or just after being coupled.

Housing 18 is formed of plastic and is comprised of two longitudinal sections 44 and two end caps 46. As seen in FIGS. 5–7, sections 44 have a first side 48 with a protrusion 50 that is slidably received in groove 32 and a groove 52 that is a formed as a result of sections 44 having a hooked or curvilinear end 54. Grooves 52 slidably receive protrusions 40. Second side 58 has a longitudinal groove 60 for coupling with housing 22 of male member 14.

Figure 12:
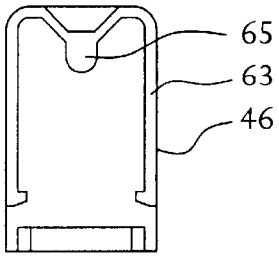
FIG. 12 is a side elevational view of the housing end cap of the female member of the electrical connector illustrated in FIGS. 2 and 5–7.
Figure 13:
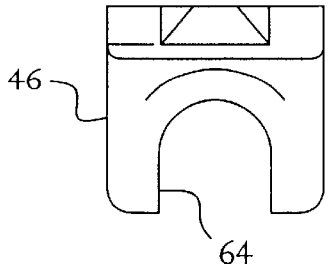
FIG. 13 is an elevational top view of the housing end cap of the female member of the electrical connector illustrated in FIG. 12.

Plastic end caps 46 cover open-ended U-shaped slot 43. As seen in FIGS. 1 and 3, end caps 46 are substantially L-shaped and have a substantially U-shaped cutout 64 for affixing to an electrically conductive stud, printed circuit board, or busbar 62 by threaded members 61. Threaded members 61 can be screw, bolts or the like. As seen in FIGS. 1 and 12, each end cap 46 has a lip 63 extending around the edge of three of the exterior walls adjacent the edge for encasing female member 12 and sections 44. Protrusion 65 extends from lip 63 and fits into U-shaped slot 43. End caps 46 are glued to female member 12 and sections 44.

Figure 17:
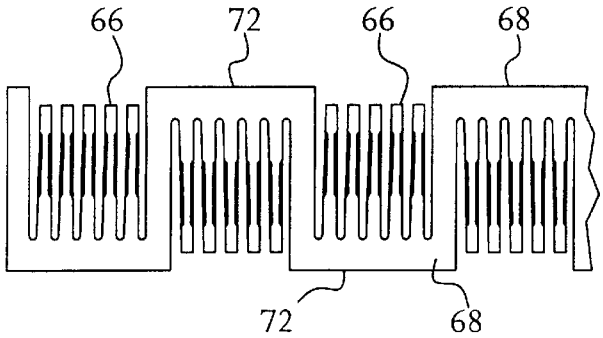
FIG. 17 is an elevational front view of the electrically conductive tines of the female member of the electrical connector illustrated in FIGS. 2 and 5–7.
Figure 18:
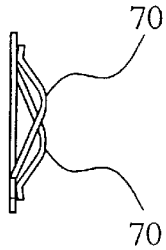
FIG. 18 is an elevational side view of the electrically conductive tines of the female member of the electrical connector illustrated in FIG. 17.

Electrically conductive contacts 20 are preferably formed of silver plated beryllium-copper and are a series of individual tines or fingers 66 coupled together by base 68. As seen in FIG. 17 and 18, contacts 20 alternate direction approximately every five tines by allowing base 68 to surround each set of five tines on three distinct sides. This alternating pattern creates a series of tines that have their peaks 70 on two separate longitudinal lines, adds rigidity to the structure, and eases insertion into the respective grooves. However, tines 66 of contacts 20 may be any size, smaller or larger (including one large continuous contact), and do not necessarily have to alternate direction.

As seen in FIGS. 5–7, edge 72 of base 68 is slidably received in groove 34 of base 24 and grooves 42 of arms 26 and 28. Beryllium-copper contacts retain more normal force over higher temperature and greater operating time than conventional phosphor-bronze contacts. This increases the usable time of the connector by creating a long lasting tight frictional fit between the contacts and the male member and an electrically conductive stud ensuring proper contact for conducting electricity.

Figure 4:
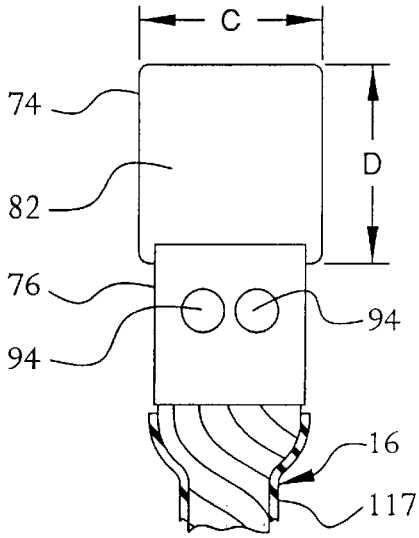
FIG. 4 is an elevational side view of the male member of the electrical connector illustrated in FIG. 2.

Male member 14 is formed from a hollow silver plated copper tube 84. As seen in FIGS. 4–11, it has an upper portion or planer tab 74 and lower portion 76. Planar tab 74 has a height B, a width C and a length D. Height B is preferably about 0.125 inches and is precisely received in the female member, frictionally engaging contacts 20 for the optimum electrical connection. However, height B may be any measurement as long as it allows the tab to engage contacts 20 and be received within female member 12. Width C varies in accordance with the gauge of the electrical cable inserted into male member 14. Larger gauge cables result in larger widths. Width C may be any measurement that results in a planar tab that allows engagement with contacts 20 and insertion into slot 43. Planar tab 74 has first and second substantially parallel planar surfaces or sides 78 and 80 defined by width C and length D. Preferably width C and length D are substantially equal, defining a surface area 82 that is substantially square, as shown in FIG. 4.

As seen in FIGS. 8–11, planar tab 74 and lower portion 76 are formed from a continuous cylindrical open-ended hollow tube 84. Tube 84 has a cylindrical inner surface 86 and a concentric cylindrical outer surface 88 with a chamfered end 90 and a flat end 92. After male member 14 is compressed, holes 94 are drilled into and through lower portion 76, as seen in FIG. 4.

Figure 14:
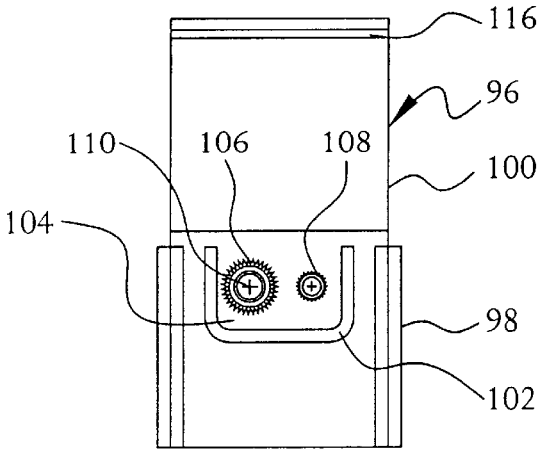
FIG. 14 is a elevational side view of the interior side of the exterior locking clamp of the male member of the electrical connector illustrated in FIGS. 2 and 5–7.
Figure 15:
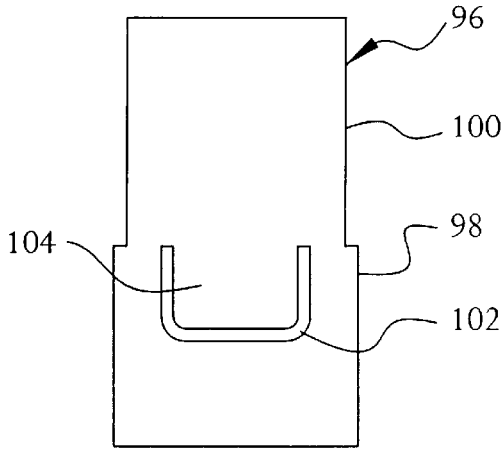
FIG. 15 is a elevational side view of the exterior side of the exterior locking clamp of the male member of the electrical connector illustrated in FIG. 14.
Figure 16:
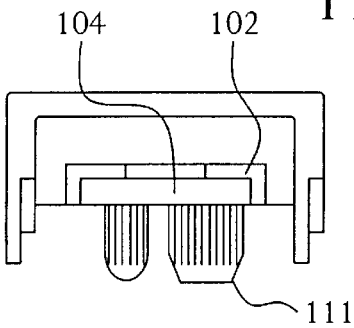
FIG. 16 is an elevational bottom view of the exterior locking clamp of the male member of the electrical connector illustrated in FIG. 14.

Holes 94 allow housing 22 to be coupled to male member 14. Housing 22 is a color-coded (black or red) plastic exterior locking clamp that releasably engages housing 18 on female member 12. Housing 22 is formed of two substantially similar halves 96 having integrally formed lower and upper portions 98 and 100. As seen in FIGS. 14–16, lower portions 98 have a U-shaped groove 102 defining tab 104. When assembled, tab 104 is flush with lower portions 76, of male member 14, positioning each half 96 in it standard configuration, as shown in FIG. 5. Tab 104 has two interior protrusions 106 and 108. Protrusions 106 have a centered hole 110 in end 111 that receives protrusions 108. As seen in FIGS. 1 and 7, lower portions 98 also have a wall 112 that substantially covers lower portion 98 and exposed portion 114 of cable 16, protecting the user from harm. Additional, lower portions 98 act as lever arms for releasing housing 22 from housing 18, as seen in FIGS. 5 and 6.

Upper portions 100 are the locking clamp or retaining clip portion of housing 22. As seen in FIGS. 5–7 and 14, upper portions 100 have a longitudinal protrusion 116 that extends substantially the width of upper portion 100 and is received in groove 60 of housing 18. The mating of groove 60 and protrusion 116 ensures that male member 14 and female member 12 will not accidentally separate.

Since lower and upper portions 98 and 100 are integrally formed, when inward pressure is applied to lower portions 98, the upper portion pivots around tab 104. This pivoting biases upper portion outwardly and away from planar tab 74. Releasing lower portions 98 biases upper portions 100 inwardly and towards planar tab 74.

Preferably, cable 16 is a high strand count cable capable of conducting high current and surrounded by insulation 117. The high strand count ensures sufficient flexibility for assembly and enables the cable to form fit within the male member during fabrication. However, cable 16 may be any electrically conductive material or combination of materials or gauge of wire that allows cable 16 to mold to the interior surface of lower portion 98. In addition, cable 16 does not have to be a single cable, but may be several smaller cables, as long as the total circular mil area is equivalent to the desired cable. As an example, preferably, cable 16 is a 1/0 American wire gauge (awg) cable, but may be four 6 awg cables. This example is not meant to limit cable 16 to these specific gauges; it is only an illustration of a few possible combinations.

Assembly

Regarding assembly of electrical connector 10, first the width A of slot 43 is to be determined and therefore the width of female member 14. The width determines the number and size of the male members to be inserted therein. As stated above, the width A can be as narrow as 0.5 inches to accommodate one small male member or may be four feet or greater to accommodate a plurality of male members. As seen in FIGS. 5–7, sections 44 are then sized to substantially the same length as female member 12, and protrusions 50 of sections 44 are slidably received in grooves 36 and 38 in arms 26 and 28, and protrusions 40 are slidably received in grooves 52 in sections 44. Contacts 20 are then sized to substantially the same length of female member 12 and are slidably received in groove 34 in base 24 and grooves 42 in arms 26 and 28. However, it is possible to insert insulation into groove 34. Insulation is inserted into groove 34 when the female member must be insulated from its mounting surface, such as metal frame of a system enclosure. End caps 62 are glued to female member 12 covering the open ends of U-shaped slot 43, as seen in FIGS. 1–3. End Caps 46 are then attached to the stud 62 using threaded members 61 through U-shaped cutouts 64. Stud 62 may be a printed circuit board or busbar, or the like if contacts are inserted into groove 34. In this configuration, if width A of female member 12 is at least twice as wide as width C of male member 14, then the female member is capable of fitting multiple male members, thus allowing a cable to cable connection.

Figure 9:
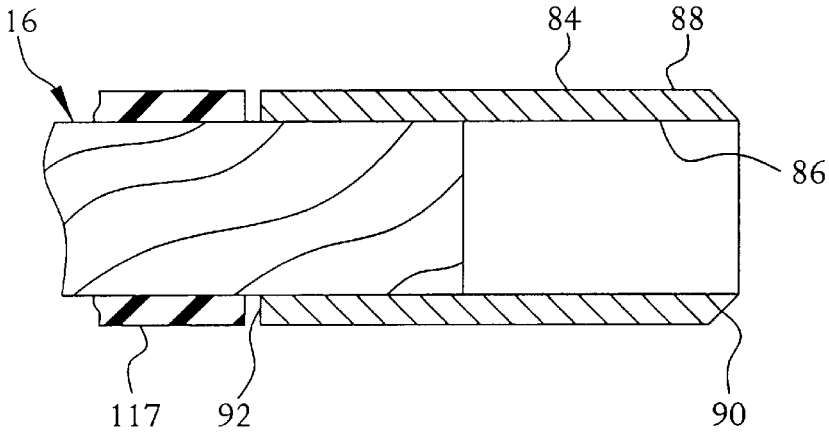
FIG. 9 is a cross-sectional side view of the male member of the electrical connector illustrated in FIGS. 2 and 5–7 prior to compressing the male member and cable to form a continuous male member.
Figure 11:
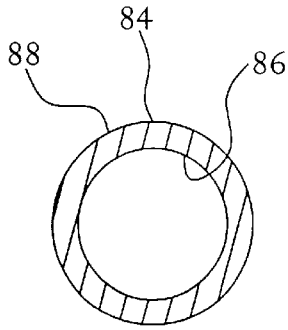
FIG. 11 is a cross-sectional side view of the tube by itself taken along lines 11—11 of FIG. 8.
Figure 10:
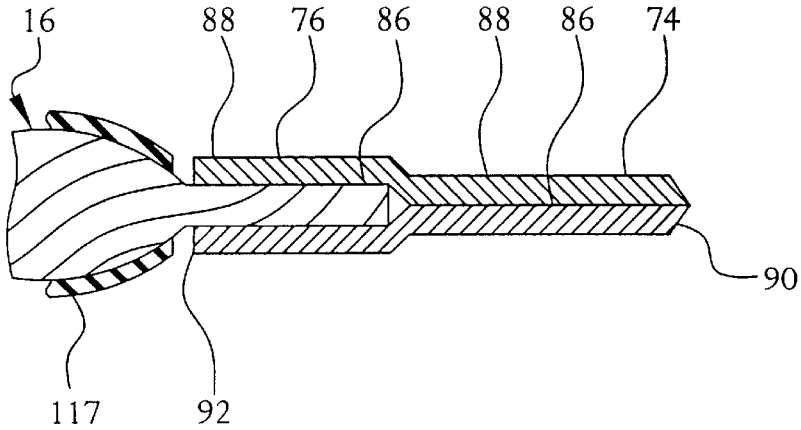
FIG. 10 is a cross-sectional side view of the male member of the electrical connector illustrated in FIGS. 2 and 5–7 after the male member and cable are simultaneously compressed.

To assemble the male member 14, cable 16 is inserted slightly less than half way into tube 84 through end 92, as seen in FIG. 9. Tube 84 and cable 16 are then compressed to form male member 14. As seen in FIG. 10, planar tab 74 is formed with a slight point due to the chamfered portion at end 90. Lower portion 76 is formed when cable 16 is compressed with tube 84 and frictionally engages inner surface 86. This process forms a substantially continuous nearly solid male member with a relatively high contact surface area. As seen in FIGS. 4–7, protrusions 106 and 108 of halves 96 are then inserted into holes 94. Each protrusion 106 engages the opposing protrusion 108 and protrusion 108 is inserted into hole 110 and the exterior of protrusion 108 engaging the interior of the hole and frictionally locking the two substantially similar halves 96 together.

Operation

As seen in FIG. 6, pressure is applied to lower portions 100 of housing 22, moving the two lower portions 100 toward cable 16. Since upper and lower portions 98 and 100 are integrally formed, this pressure on the lower portion causes the upper portion to pivot around tab 104 and spread apart or each half of upper portion 100 to be biased away from planar tab 74. Planar tab 74 is then inserted into U-shaped slot 43, surfaces 78 and 80 frictionally engaging contacts 20 on the interior of slot 43. This frictional engagement in itself is usually enough to hold male member 14 and female member 12 together. However, as an added safety measure once the pressure is removed from lower portions 98, upper portions 100 are biased in a spring like manner toward planar tab 74 and engage sections 44 on housing 18. Protrusions 116 engage grooves 60 further securing female member 12 to male member 14. If width A of female member 12 is at least twice that of width C of male member 14, a plurality of male members may be inserted into female member 12, as seen in FIG. 1, in the same manner as described above.

Forming an electrical connector as described, results in an efficient low voltage power connection. As described above, in a single voltage, single current configuration, it is desirable to have a low voltage drop. This is possible by providing a connector with as much electrically conductive surface area as possible in the connection. In the present invention, by forming the connector from electrically conductive metals and having a male member formed by simultaneously compressing a silver plated copper tube with a high strand cable and a female member with a plurality of conductive tines, a connector with a relatively high conductive surface area is formed. This results in low contact surface resistance and a low voltage drop across the connector.

Additionally, by manufacturing the female member in such a way that it may be 0.5 inches or twice as wide as the male member or greater, multiple male members may be inserted, thus creating an electrical system that may adapt and expand as desired.

The releasable external locking clamps make inserting and removing the male members simple, requiring no tools, thus facilitating adaptation and expansion of the connector. In addition, the locking clamps resist vibration, thereby decreasing the likelihood of accidental disconnection.

Figure 19:
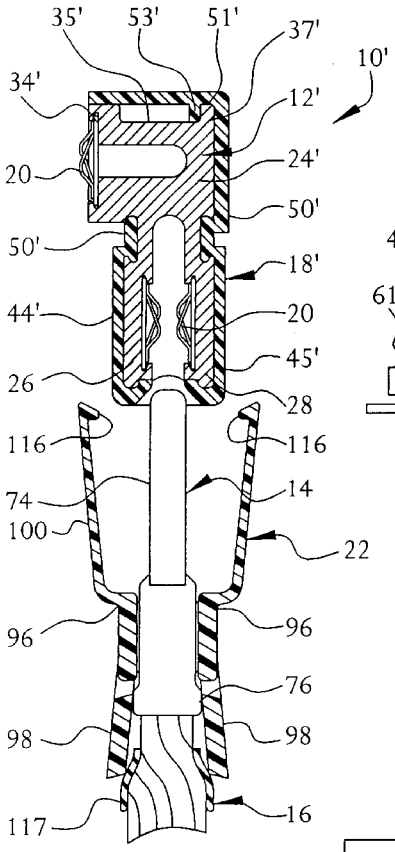
FIG. 19 is cross-sectional side view of a second embodiment of the present invention in which the female member is substantially L-shaped.
Figure 20:
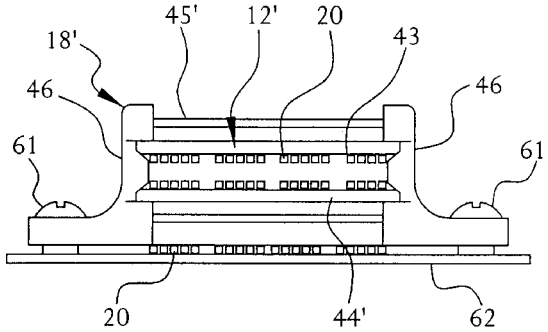
FIG. 20 is an elevational top view of the female member of the electrical connector illustrated in FIG. 19.
Figure 21:
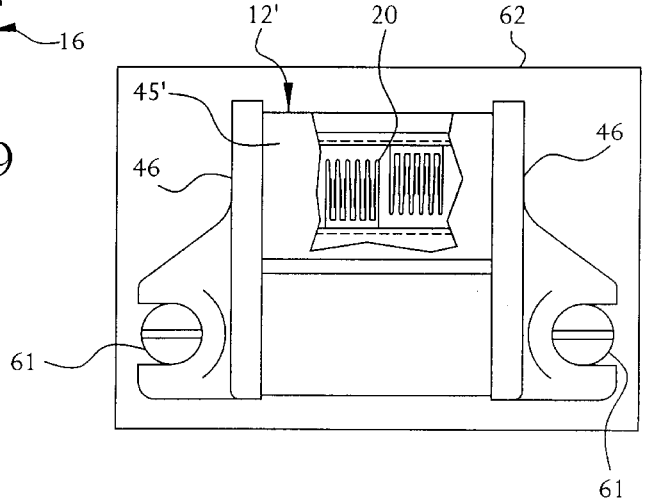
FIG. 21 is a partial side cross-sectional view female member of the electrical connector illustrated in FIG. 20.

Second Embodiment of FIGS. 19–21 Referring to FIGS. 19–21, according to a second embodiment of the present invention, electrical connector 10' has a substantially L-shaped female member 12' that is capable of connecting to stud 62 at substantially a right angle. However, female member 12' may form any angle that would allow easier access to slot 43. Electrical connector 10' is similar to elector connector 10 except for a few modifications. Assembly and operation are basically the same.

Female member 12' has a base 24' with an exterior open ended longitudinal groove 34' for slidably receiving contacts 20 and a groove 35' and protrusion 37' for engaging housing 18'. Housing 18' is formed of two sections 44' and 45' and two end caps 46. As seen in FIG. 19, housing 18' is a modified version of housing 18, having a similar configuration for the portions covering arms 26 and 28. However, section 44' is shorter than section 44 ending at protrusion 50'. Section 45' extends beyond protrusion 50' and has a substantially 90-degree bend to cover the base. Section 54' also has additional groove 51' and a protrusion 53' that slidably engage protrusions 37' and 35', respectively. As seen in FIGS. 20 and 21, this configuration allows U-shaped slot 43 of female member 12' to be mounted substantially parallel to stud 62 for easy access to slot 43. However, slot 43 does not need to be parallel and can be at any other angle that may facilitate insertion of planar tab 74 into U-shaped slot 43.

The features of connector 10', which are similar to connector 10, are identified with like reference numbers. The same description, as provided above regarding FIGS. 1–18, of those similar features is applicable.

While a few specific embodiments have been chosen to illustrate the invention, it will be understood by those skilled in the art that various changes and modifications can be made therein without departing from the scope of the invention as defined in the appended claims.

What is claimed is:

1. An electrical connector for connecting an electrical cable to a conductive member, comprising:

an electrically conductive female member having an open-ended longitudinal slot with a first wall and a second wall defining a width;

a first electrically conductive tine and a second electrically conductive tine received in a groove in the first and second walls, respectively, and electrically connected thereto; and an electrically conductive male member having a substantially planar tab, said tab having substantially parallel first and second sides defining a height and a width and receivable within said longitudinal slot, said first and second parallel sides electrically and frictionally engaging the first and second tines, respectively, compressing the tines toward the wall in which each tine is received;

wherein said width of said longitudinal slot is at least twice as large as said width of said planar tab, thereby allowing said longitudinal slot to receive a plurality of said planar tabs.

2. An electrical connector according to claim 1, wherein said width is substantially the same as a length.

3. An electrical connector according to claim 1, wherein said slot is substantially U-shaped in cross section.

4. An electrical connector according to claim 1, wherein said female member is substantially L-shaped, allowing said female member to electrically contact a stud at a substantially 90 degree angle.

5. An electrical connector according to claim 1, wherein said male member is formed of silver-plated copper.

6. An electrical connector according to claim 5, wherein said male member is coupled to an electrically conductive high current cable.

7. An electrical connector according to claim 1, wherein said first and second tines are opposed.

8. An electrical connector according to claim 7, wherein said height allows said first and second tines to frictionally engage said first and second parallel sides.

9. An electrical connector according to claim 1, wherein said female member has a housing.

10. An electrical connector according to claim 9, wherein said male member has an exterior locking clamp releasably engaging said housing on said female member.

11. An electrical connector according to claim 10, wherein said exterior locking clamp is comprised of two substantially similar halves coupled together, each half having a protrusion at a first end.

12. An electrical connector according to claim 11, wherein said housing has two longitudinal grooves for mating with said protrusion on each half of said exterior locking clamp.

13. An electrical connector for connecting an electrical cable to a conductive member, comprising:

an electrical cable;

an electrically conductive female member having an open-ended longitudinal slot with a width and at least one electrically conductive member received therein; and an electrically conductive male member coupled to said electrical cable and having substantially planar first and second outer surfaces defining a height and a width and receivable within said longitudinal slot, at least one of said first and second surfaces contacting said at least one electrically conductive member, and an inner surface, a first portion of said inner surface frictionally engaging and thereby coupling the electrical cable to the male member, and a second portion of said inner surface being compressed so that the inner surface forms first and second inner faces that are proximal one another;

wherein said width of said longitudinal slot is at least twice as large as said width of said electrically conductive male member, thereby allowing said longitudinal slot to receive a plurality of said planar tabs.

14. An electrical connector according to claim 13, wherein said an electrically conductive female member has a first wall and a second wall and a first electrically conductive member and a second electrically conductive member received in a groove in the first and second walls, respectively, and electrically connected thereto; and said first and second outer surface electrically and frictionally engages the first and second tines, respectively.

15. A method of producing an electrical connector for connecting an electrical cable to a conductive member, comprising the steps of:

forming an electrically conductive female member having a base, an open-ended longitudinal slot with a longitudinal width, and at least one electrical contact received in said slot;

forming a hollow electrically conductive tube having an open end and an interior surface extending along an interior length of the tube;

inserting an electrically conductive cable into said open end of said tube, so that said electrically conducted cable extends partially along said length;

compressing a first portion of said tube and said wire, so that a portion of said interior surface engages said wire, thereby coupling said cable within said tube; and compressing a second portion of said tube, so that said second portion forms a continuous male member having a planar tab with substantially none of the wire therein and with substantially parallel first and second sides defining a height and a width and receivable within said longitudinal slot, at least one of first and second parallel sides contacting said electrical contact.

16. A method according to claim 15, wherein said width of said longitudinal slot is at least twice as large as said width of said planar tab, thereby allowing said longitudinal slot to receive a plurality of said planar tabs.

17. A method according to claim 15, wherein said tube is formed of silver-plated copper.

18. A method according to claim 15, wherein said base has a plurality of electrical contacts received therein, said electrical contacts contacting an electrically conductive stud.

19. A method according to claim 15, wherein said electrical contact frictionally engages at least one of said first and second parallel sides.

20. A method according to claim 15, wherein said base is insulated, thereby preventing said female member from electrically contacting a surface to which it is mounted.

21. A method according to claim 15, wherein said female member is L-shaped, allowing said female member to electrically contact a stud at a substantially 90-degree angle.

22. A method for producing an electrical connector for connecting an electrical cable to a conductive member, the steps comprising:

forming an open ended metallic tube having an interior surface, inserting an electrically conductive cable at least partially into the open ended tube, so that the cable is adjacent a portion of the interior surface, compressing the open ended tube and cable to form an electrically conductive male member having a planar tab, the tab having substantially parallel first and second sides defining a height, a width and a portion wherein the interior surface is compressed so that the cable is not therebetween;

forming an electrically conductive female member having an open-ended longitudinal slot with a width and an electrical contact received therein; and inserting the planar tab into the longitudinal slot and engaging at least one of the first and second parallel sides with the electrical contacts.

23. A method for producing an electrical connector according to claim 22, wherein the width of said longitudinal slot is at least twice as large as the width of the planar tab, thereby allowing said longitudinal slot to receive a plurality of said planar tabs.

24. A method for producing an electrical connector according to claim 22, wherein the tube is formed of silver-plated copper.

* * * * *